United States Patent [19]

Herklotz et al.

[11] 4,354,152

[45] Oct. 12, 1982

[54] METHOD FOR AUTOMATIC CONTROL OF THE VOLTAGE OF AN ELECTROSTATIC FILTER AT THE BREAKDOWN LIMIT

[75] Inventors: Helmut Herklotz, Neu Isenburg; Günter Mehler, Frankfurt am Main; Franz Neulinger, Dietzenbach; Helmut Schummer, Heusenstamm; Horst Daar, Erlangen; Walter Schmidt, Uttenreuth; Heinrich Winkler, Neunkirchen, all of Fed. Rep. of Germany

[73] Assignee: Siemens Aktiengesellschaft, Munich, Fed. Rep. of Germany

[21] Appl. No.: 213,093

[22] Filed: Dec. 4, 1980

[30] Foreign Application Priority Data

Dec. 11, 1979 [DE] Fed. Rep. of Germany ..... 2949664

[51] Int. Cl.[3] ..... B03C 3/68

[52] U.S. Cl. ..... 323/241; 323/903; 55/105

[58] Field of Search ..... 323/241, 246, 903; 361/235; 55/105, 139

[56] References Cited

U.S. PATENT DOCUMENTS

| | | | |
|---|---|---|---|
| 3,577,708 | 5/1971 | Drenning | 323/903 X |
| 3,745,749 | 7/1973 | Gelfand | 323/903 X |
| 4,138,232 | 2/1979 | Winkler et al. | 55/105 |

*Primary Examiner*—J. D. Miller
*Assistant Examiner*—Peter S. Wong
*Attorney, Agent, or Firm*—Kenyon & Kenyon

[57] ABSTRACT

A method for controlling the voltage of an electrostatic filter at the breakdown limit in which, when a breakdown occurs, the voltage is reduced by an amount which is determined by the breakdown voltage and the prior history of the breakdown and the waiting time to the next increase of the filter voltage is made dependent on the ratio of the voltages at successive breakdowns by comparing voltage amplitudes which immediately precede the breakdowns.

7 Claims, 3 Drawing Figures

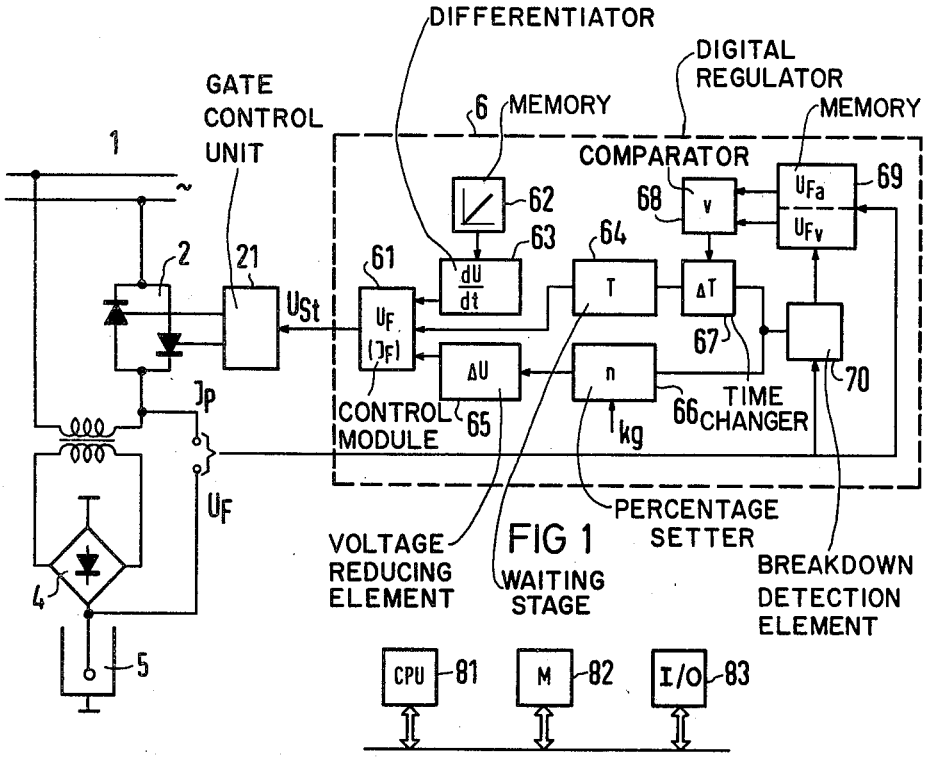
FIG 1
FIG 1A
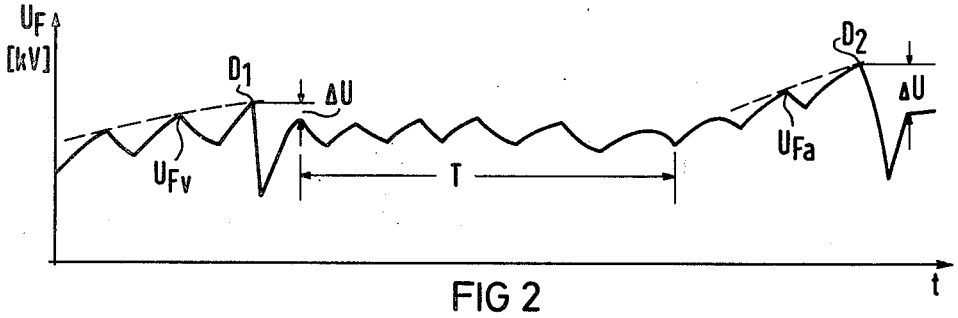
FIG 2

METHOD FOR AUTOMATIC CONTROL OF THE VOLTAGE OF AN ELECTROSTATIC FILTER AT THE BREAKDOWN LIMIT

BACKGROUND OF THE INVENTION

This invention relates to a method for automatic control of the voltage of an electrostatic filter at the breakdown limit by means of a time dependent increase of the filter voltage to breakdown and a subsequent breakdown dependent decrease.

A method of this general nature is described for example in German Patent Application DE-AS No. 11 48 977.

The degree of separation of an electrostatic separator is higher, the closer the operating voltage is to the flashover limit. Since flashover limit varies during operation as a function of several factors, such as, for example, gas composition, dust content and temperature, the voltage of the electrostatic separator must be regulated as a function of the level of the flashover limit.

In the method according to the above mentioned DE-AS No. 11 48 977, a control capacitor is charged across a resistance as a function of the filter current. A continuously variable tube which in turn is energized by a capacitor is connected in parallel with this control capacitor as a discharging resistance. This capacitor is charged in a breakdown dependent manner and is discharged continuously via a parallel resistance. The voltage at the control capacitor is used as a control voltage for a final control element on the primary side. The current dependence of the charging voltage for the control capacitor is chosen so that at low separator current strengths a relatively rapid voltage increase is obtained, and at high separator current strengths a relatively slow one. Through the constant discharge of the control capacitor dependent on the flashovers, the separator voltage after flashovers is lowered by an amount given by the number or duration of the flashovers.

In this control method, the prior history of the breakdown just then present enters in the voltage decrease or respectively the increase up to the breakdown limit as a relatively minor or largely undefined factor.

SUMMARY OF THE INVENTION

It is the object of the present invention, in stationary operation in which the breakdown limit is continuously sampled as a function of time, to optimize the control method in such a way the one operates at the breakdown limit to the greatest extent possible while the number of breakdowns required for operating at this limit, during which actual separation is not possible, is maintained within predetermined limits.

According to the present invention, this problem is solved by reducing, after each breakdown, the voltage or the current by a percentage of the existing breakdown voltage or breakdown current which is dependent on the breakdown frequency during a preceding fixed period of time, and shortening the waiting time to a new voltage increase if the measured voltage amplitude at breakdown has increased relative to the measured voltage amplitude at the preceding breakdown, and vice versa.

In this manner the voltage is lowered by a percentage which is determined by the breakdown voltage on the one hand and by the prior history of the breakdown, on the other. Similarly, the waiting time is also fixed so that breakdowns will not be unduly frequent.

To attain defined conditions during increase to breakdown, the filter voltage is advantageously increased to breakdown at a fixed, preselectable voltage gradient which depends on the operational state of the installation.

If during the waiting time a breakdown occurs, the voltage increase planned at the end of the waiting time is advantageously omitted, but the new waiting time beginning at that moment is shortened.

It is thereby achieved that there will not be a succession of breakdowns in an uncontrolled number. To take into account the varying filter performance in relation to the waiting time, the waiting time is further advantageously variable in steps of different magnitude, e.g. the steps can be chosen in the form of a geometric series.

Since thyristors are presently normally used as control elements for electrostatic filters, and the phase angle control of these thyristors becomes noticeable on the d-c voltage side in a pulsation of the filter voltage, it is advantageously provided, in order to obtain defined points for the comparisons, to compare the crests of the voltage half-waves on the d-c voltage side immediately before the breakdowns.

In a device for carrying out the method according to the present invention where the electrostatic filter is fed from an a-c voltage source via a rectifier, a high voltage transformer, and a final control element, a microcomputer is advantageously provided for giving a set control voltage to the final control element. The microcomputer computes from the measured and stored filter data, the required reduction and the waiting time as well as other parameters.

BRIEF DESCRIPTION OF THE DRAWINGS

FIG. 1 shows the usual voltage supply for an electrostatic filter with a digital regulator operating by the method of the invention.

FIG. 1A illustrates the replacement of this digital regulator by a microcomputer system.

FIG. 2 illustrates the voltage conditions during sampling of the breakdown limit.

DETAILED DESCRIPTION

As can be seen from FIG. 1, an electrostatic filter 5 is fed from an alternating current network 1 via a rectifier and a high voltage transformer 3. On the primary side, between the high voltage transformer 3 and a-c network 1, an a-c controller 2 consisting of antiparallel connected thyristors is provided. A thyristor gate control unit 21 receives its control voltage $U_{St}$ from a digital regulator 6, shown framed by broken lines. Digital regulator 6 nowadays as a rule comprises the type of microcomputer system shown in FIG. 1A programmed to function as shown in FIG. 1. This microcomputer system includes as essential components, a central processing unit 81, a memory 82, and input/output devices 83 with which measured values and data can be obtained from and supplied to peripherals, e.g., A/D converters for $I_p$ and $U_F$ and D/A converters for supplying $U_{St}$.

For better comprehension of the regulating process the digital regulator is shown in the form of permanently wired functional modules. This also constitutes a flow diagram which indicates the manner in which the microcomputer may be programmed.

As can be seen from FIG. 1, the control voltage $U_{St}$ is supplied by a control module 61, which determines the filter voltage U or respectively the filter current I. The gradient for the increase in filter voltage to breakdown is set by module 63. The set value for this gradient is taken out of a memory 62 depending on the operating conditions of the filter. When the filter voltage reaches the breakdown value, which is determined from the primary current $I_p$ and/or the collapse of the voltage $U_F$ on the secondary side, a breakdown detection element 70 sends, via a percentage setter 66 and a voltage reducing element 65 a corresponding voltage reduction command to the voltage control unit 61. The amount of reduction in case of breakdown is calculated from:

$$U=XnU_F/100 \text{ or } I=XnI_F/100$$

X being a value between 0.2 and 1; n, the reduction step; and $U_F$, the prevailing filter voltage. The equivalent applies if instead of a filter voltage reduction a filter current reduction I of the filter current $I_F$ is effected. The value n results from the prior history of the filter; it depends on the number k of breakdowns during a preceding seek period of, e.g., 10 to 30 minutes. If the number k of breakdowns not caused by the sampling of the filter voltage limit is greater than a preselectable limit value $k_g$ of, e.g., 1000, the reduction step n is increased and a new seek period begun. Then the reduction amounts Δu are calculated and stored. If the number of breakdowns in the seek period is smaller than the limit value $k_g$, the reduction step n remains at first unchanged. If in the following seek period k is again smaller than $k_g$, the reduction step n is decreased. Thereafter the new prevailing reduction amounts Δu are again calculated and stored. To adapt to changing operating conditions, the waiting time T to a new increase of the filter voltage is also varied as a function of breakdown, that is, the value of the breakdown voltage $U_{Fv}$ deposited in a memory 69 during the preceding breakdown is compared with the prevailing breakdown voltage $U_{Fa}$. If it is found that the measured voltage amplitude at breakdown has increased relative to the measured voltage amplitude at the preceding breakdown, then by means of the comparator 68 the waiting time is shortened by the amount ΔT in the time changer element 67. This amount ΔT then correspondingly changes the waiting time T of the waiting stage 64. The waiting times are graded, for instance, in a geometric series. If the comparisons show, for instance, that the prevailing breakdown voltage is always higher than the preceding breakdown voltage, then the waiting times are shortened by amounts ΔT which for instance increase in a geometric series. The reverse applies if the values are always lower. If during the waiting time at least one breakdown occurs, the voltage increase planned at the end of the waiting time is omitted, but the waiting time beginning at that moment is also shortened by the amount ΔT after the prevailing variation stage.

FIG. 2 shows the voltage waveforms at the filter. As can be seen, due to the phase-angle control and the rectifiers, pulsating half-waves appear at the filter on the secondary side. If at point D1 a provoked breakdown occurs, the filter voltage $U_F$ will at first collapse, and then the returning filter voltage is reduced by an amount Δu which can be calculated with the above-stated equation. Then follows a waiting time T until the moment S, from which time on the filter voltage $U_F$ is again increased to the provoked breakdown D2, whereupon the voltage $U_F$ is lowered again by an amount Δu.

As it is relatively difficult to determine the actual breakdown voltage because of the pulsation of the voltages, the voltage comparison values determining for the waiting time are determined from the crests of the voltage half-waves just before the breakdowns. To this end the crest values are picked up and stored continuously, using for the comparison those values (e.g. $U_{Fa}$, $U_{Fv}$) which immediately precede the breakdown.

In the above-described manner, one obtains an optimum control of the filter voltage at the breakdown limit.

The microcomputer may be any one of those currently available such as Motorola 6805, Intel 8080A, Z-Log Z-80, etc.

What is claimed is:

1. In a method for automatic control of the voltage of an electrostatic filter at the breakdown limit by a time dependent increase of the filter voltage to breakdown and subsequent breakdown dependent decrease, the improvement comprising, after each breakdown, reducing the voltage or the current by a percentage of the breakdown voltage or current which is dependent on the breakdown frequency during a preceding fixed period of time, and shortening the waiting time to a new voltage increase if the measured voltage amplitude at breakdown has increased relative to the measured voltage amplitude at the preceding breakdown, and lengthening the waiting time to a new voltage increase if the measured voltage amplitude at breakdown has decreased relative to the measured voltage amplitude at the preceding breakdown.

2. The method according to claim 1, comprising increasing the filter voltage with a fixed, preselectable voltage gradient to breakdown.

3. The method according to claim 1, comprising omitting the voltage increase planned at the end of the waiting time if at least one breakdown occurs during the waiting time but establishing a shortened new waiting time beginning at this moment.

4. The method according to claim 1, comprising varying the waiting time in steps of different magnitude.

5. The method according to claim 4, comprising choosing the steps in the form of a geometric series.

6. The method according to claim 1, comprising comparing the crests of the voltage half-waves just before the breakdowns.

7. In a electrostatic filter which is fed from an a-c voltage source via a rectifier, a transformer and a final control element, apparatus for automatic control at the breakdown limit, comprising a microcomputer supplying a set control voltage to the control element, said microcomputer programmed to compute from the measured and stored filter values and data the required reduction of the filter voltage or filter current at breakdown and the waiting time until the next increase of the filter voltage such that, after each breakdown, the voltage or current is reduced by a percentage of the breakdown voltage or current which is dependent on the breakdown frequency during a preceding fixed period of time, and the waiting time to a new voltage increase is shortened if the measured voltage amplitude at breakdown has increased relative to the measured voltage amplitude at the preceding breakdown, and lengthened if the measured voltage amplitude at breakdown has decreased relative to the measured voltage amplitude at the preceding breakdown.

* * * * *

UNITED STATES PATENT AND TRADEMARK OFFICE

CERTIFICATE OF CORRECTION

PATENT NO. : 4,354,152

DATED : October 12, 1982

INVENTOR(S) : HELMUT HERKLOTZ et al.

It is certified that error appears in the above-identified patent and that said Letters Patent are hereby corrected as shown below:

On the title page, change items [73] and [30] to read as follows:

--[73] Assignee: Siemens Aktiengesellschaft, Munich, Fed. Rep. of Germany and Metallegesellschaft Aktiengesellschaft, Frankfurt/Main, Fed. Rep. of Germany--

--[30] Foreign Application Priority Data
Dec. 11, 1979 [DE] Fed. Rep. of Germany.....2949764--

Signed and Sealed this

*Tenth* Day of *January 1984*

[SEAL]

*Attest:*

GERALD J. MOSSINGHOFF

*Attesting Officer*

*Commissioner of Patents and Trademarks*